US011198210B2

(12) United States Patent
Klotblixt

(10) Patent No.: US 11,198,210 B2
(45) Date of Patent: Dec. 14, 2021

(54) ELECTRIC PULSE TOOL

(71) Applicant: ATLAS COPCO INDUSTRIAL TECHNIQUE AB, Stockholm (SE)

(72) Inventor: Adam Klotblixt, Stockholm (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 235 days.

(21) Appl. No.: 16/606,692

(22) PCT Filed: Apr. 5, 2018

(86) PCT No.: PCT/EP2018/058662

§ 371 (c)(1),
(2) Date: Oct. 18, 2019

(87) PCT Pub. No.: WO2018/192775

PCT Pub. Date: Oct. 25, 2018

(65) Prior Publication Data

US 2020/0055167 A1 Feb. 20, 2020

(30) Foreign Application Priority Data

Apr. 19, 2017 (SE) ..... 1730108-6

(51) Int. Cl.
*B25B 21/02* (2006.01)

(52) U.S. Cl.
CPC ..... *B25B 21/02* (2013.01)

(58) Field of Classification Search
CPC ..... B25B 21/02; B25B 21/002; B25B 21/00; B25B 21/023; B25B 21/026; B25B 21/004
See application file for complete search history.

(56) References Cited

U.S. PATENT DOCUMENTS 4,231,271 A * 11/1980 Yamada ..... B25B 13/481 81/57.3
5,440,215 A * 8/1995 Gilmore ..... B23P 19/066 173/178

(Continued)

FOREIGN PATENT DOCUMENTS

SE 1551333 A1 4/2017
WO 9962675 A1 12/1999

OTHER PUBLICATIONS

International Preliminary Report on Patentability (IPRP) dated Mar. 18, 2019 issued in International Application No. PCT/EP2018/058662.

(Continued)

*Primary Examiner* — Robert J Scruggs
(74) *Attorney, Agent, or Firm* — Holtz, Holtz & Volek PC

(57) ABSTRACT

In a method for an electric pulse tool, which is configured to deliver torque pulses on an output shaft, in each of a plurality of periods, a current pulse is provided to an electric motor during a current-on time and a current feed is paused during a current-off time. The method includes retrieving a parameter reflecting an amount of reaction force that the operator of the electric pulse tool can be exposed to, and determining the current-off time based on the parameter. The determined current off time includes a first off interval until an end of a torque pulse and a second off interval after the end of the torque pulse. The second off interval is based on a width of the torque pulse, such that a wider torque pulse results in a wider off interval and a narrower torque pulse results in a shorter off interval.

12 Claims, 3 Drawing Sheets

(56) References Cited

U.S. PATENT DOCUMENTS

| | | | | |
|---|---|---|---|---|
| 5,731,673 | A | 3/1998 | Gilmore | |
| 6,680,595 | B2 * | 1/2004 | Ito | B25B 23/1405 173/11 |
| 7,770,658 | B2 | 8/2010 | Ito et al. | |
| 2003/0090227 | A1 | 5/2003 | Ito | |
| 2013/0008679 | A1 * | 1/2013 | Nishikawa | B25B 21/02 173/93 |

OTHER PUBLICATIONS

International Search Report (ISR) dated Jul. 23, 2018 issued in International Application No. PCT/EP2018/0058662.

* cited by examiner

ELECTRIC PULSE TOOL

TECHNICAL FIELD

The invention relates to a controller for an electric pulse tool and a method in a controller for an electric pulse tool. In particular the invention relates to a controller and a method in a controller for configuring an electric pulse tool with respect to the characteristics of the reaction force of the electric pulse tool.

BACKGROUND

Electric power tools for fastening bolts, screws and nuts are used in many different applications. In some of these applications it is desired or even required to be able to control the clamping force or at least an associated torque. Such electric power tools are typically controlled to rotate an output shaft of the electric power tools such that the torque is measured. When the torque reaches a predetermined value the electric power tool is controlled to stop the rotation of the output shaft. This can for example be accomplished by cutting the power to the tool or a clutch can be slid.

A problem encountered when operating electric power tools, in particular a handheld electric power tools, is that the operator is subject to a reaction force. One way to reduce the reaction force transferred to the operator is to use a pulsed electric motor that is fed with a series of energy pulses driving the electric motor in a pulsed manner. The energy can typically be supplied as current pulses. Hereby the reaction force that the operator needs to cope with can be reduced.

U.S. Pat. No. 6,680,595 describes a control method and a fastening apparatus for fastening a screw. The fastening apparatus is controlled to output a pulsed increasing torque. The actual torque is determined and the motor is stopped when the actual torque reaches a target value. The pulsed increasing torque is generated by feeding a pulsed current to the electric motor of the fastening apparatus.

Also, U.S. Pat. No. 7,770,658 describes a control method and a fastening apparatus for fastening a screw. The actual torque is determined and the motor is stopped when the actual torque reaches a target value. Further, when the actual torque reaches a set value the torque delivered by the fastening apparatus is reduced. The pulsed torque is generated by feeding a pulsed current to the electric motor of the fastening apparatus.

There is a constant desire to improve the operation of power assisted fastening tools. For example the reaction force transferred to the operator should be as small as possible to improve the working conditions of the operator.

Hence, there exists a need for an improved controller and method of controlling an electric pulse tool.

SUMMARY

It is an object of the invention to provide an improved controller and a method of controlling an electric pulse tool where the characteristics of the reaction force is improved so that the electric pulse tool becomes more ergonomic to use.

This object is achieved in accordance with a first aspect of the disclosure by a method for configuring an electric pulse tool, where torque is delivered in torque pulses on an output shaft of the electric pulse tool. Wherein for each period a current pulse is provided to an electric motor during a first current on time and current feed is paused during a determined current off time. The method comprises the following steps. Retrieving a parameter value reflecting amount of reaction force that the operator of the electric pulse tool can be exposed to. And determining the current off time based on the parameter value.

In accordance with a second aspect the disclosure relates to a controller for an electric pulse tool, where torque is delivered in torque pulses on an output shaft of the electric pulse tool. Wherein for each period a current pulse is provided to an electric motor during a first current on time and current feed is paused during a determined current off time. The controller is operative to, retrieve a parameter value reflecting amount of reaction force that the operator of the electric pulse tool can be exposed to. And determine the current off time based on the parameter value.

An advantage with exemplary embodiments of the disclosure is that the characteristics of the reaction force is improved so that the electric pulse tool becomes more ergonomic to use.

BRIEF DESCRIPTION OF THE DRAWINGS

The invention will now be described in more detail and with reference to the accompanying drawings, in which.

DETAILED DESCRIPTION

Conventional power tools such as nutrunners or screw drivers are typically provided with sensors, such as angle encoders and/or torque meters, which make it possible to control the quality of a performed work operation, such as the tightening of a joint.

Further, for hand held power tools in particular, it is important both that the reaction force that the operator is subject to is as low as possible and that the time of concluding a specific tightening operation is as short as possible. An operator may conduct many hundreds of tightening operations during a working cycle and it is therefore important that they are both ergonomic for the well-being of the operator and rapid for the productivity at the work station. An ergonomic tightening operation typically implies that the reaction force is as low as possible.

Figure 1:
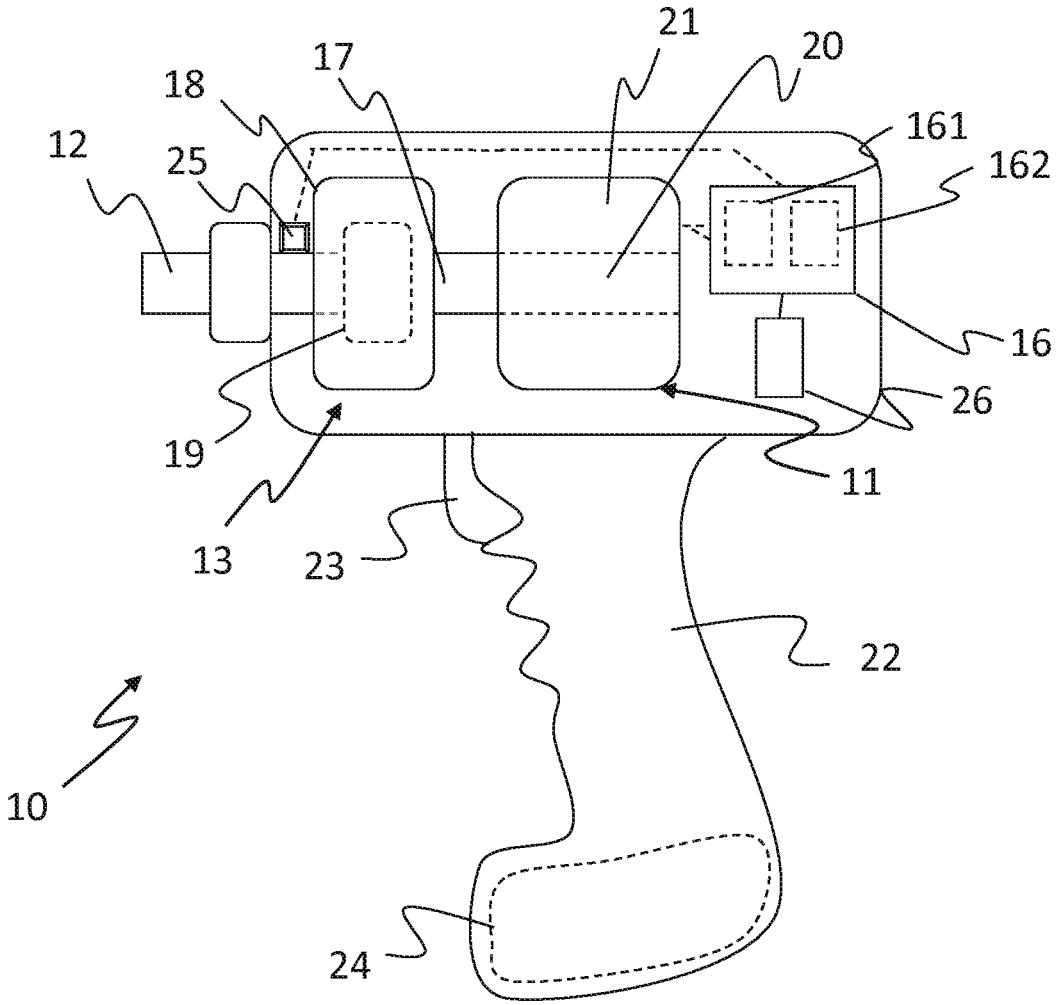
FIG. 1 shows a longitudinal section through a power tool.

FIG. 1 depicts an exemplary embodiment of an electric pulse tool 10 in accordance with an embodiment of the invention. The tool 10 is configured to perform tightening operations where torque is delivered in a series of pulses to tighten screw joints or a similar action involving a rotational action performed by the tool 10. For this purpose the pulse tool comprises an electric motor 11 having a rotor 20 and a stator 21. The electric motor 11 is arranged to be rotated in two opposite rotational directions, clockwise and counter clockwise.

The tool 10 further comprises a handle 22, which is of a pistol type in the shown embodiment. The invention is however not limited to such a configuration but can be applied in any type of electric pulse tool and not limited to the design of FIG. 1. A power supply 24 is connected to the motor 11. In the embodiment shown the power supply is a battery that can be arranged in the lower part of the handle. Other types of power supplies are also envisaged such as an external power supply supplying power via an electrical cable to the tool 10. The tool 10 can further comprise a trigger 23 arranged for manipulation by the operator to control the powering of the electrical motor 11. In some embodiments the tool 10 is connected to an external control unit (not shown). The external control unit can supply the tool 10 with electrical power. The control unit can also be arranged to transmit and receive signals to/from the tool 10 to control the tool. Further, the tool comprises an output shaft 12.

The invention can advantageously be applied in an electric pulse tool where the output shaft 12 is connected to the motor 11 via a gear arrangement (not shown). The invention is however not limited to such a type of power tool.

The electric pulse tool 10 further comprise a processor 16 arranged to control the electric motor 11. The electric pulse tool 10 also comprises a memory 26 containing instructions executable by the processor 16. The processor 16 is a Central Processing Unit, CPU, microcontroller, Digital Signal Processor, DSP, or any other suitable type of processor capable of executing computer program code. The memory 26 is a Random Access Memory, RAM, a Read Only Memory, ROM, or a persistent storage, e.g. a single or combination of magnetic memory, optical memory, or solid state memory or even remotely mounted memory.

According to one exemplary embodiment of the present disclosure a sensor 25 is arranged to determine if energy is provided on the output shaft. The sensor 25 is in accordance with one embodiment arranged on the output shaft 12. Alternatively the sensor 25 can be located on the gear arrangement. The sensor 25 can however be located on other places in the electric pulse tools. According to one exemplary embodiment of the present disclosure the sensor 25 is a torque sensor 25. According to another exemplary embodiment of the present disclosure the sensor 25 is a position sensor 25.

In electric pulse tools according to prior art current is supplied to the motor intermittently so that the motor generates torque pulses. Thereby less reaction force is exerted on the worker, and the worker can perform the screw fastening work by one hand.

Figure 2:
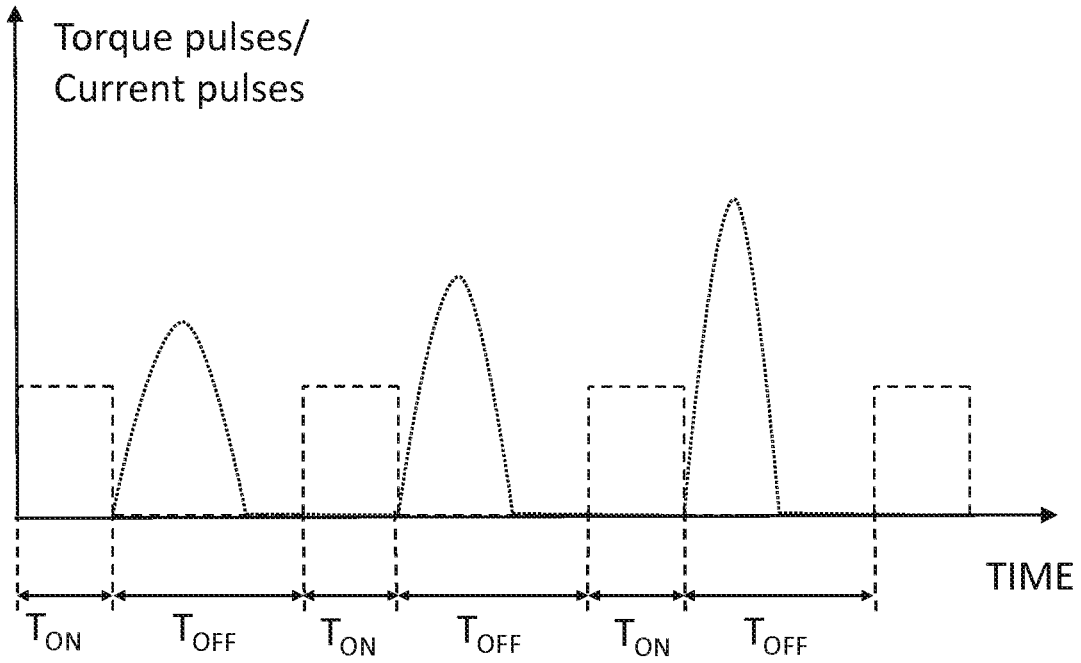
FIG. 2 depicts a diagram of a current pulse sequence according to prior art.

FIG. 2 shows pulse width modulation of an electric motor in a power tool according to prior art. FIG. 2 depicts a diagram of several periods of current pulses (dashed lines) according to prior art. As can be seen in FIG. 2 the on/off ratio is fixed. Meaning that the on-time $T_{ON}$ and off-time $T_{OFF}$ is the same for each period. FIG. 2 also depicts the torque pulses that are delivered in pulses on an output shaft of an electric pulse tool.

Figure 3:
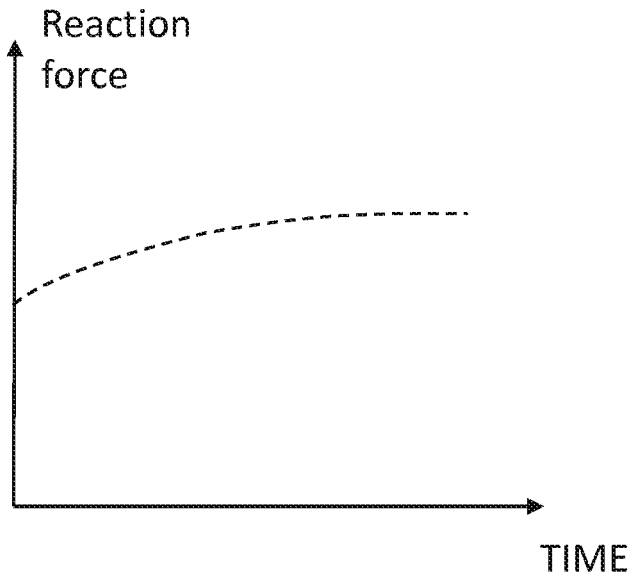
FIG. 3 depicts a diagram of the reaction force from an electric pulse tool according to prior art.

FIG. 3 illustrates the reaction force that an operator experiences when using the electric pulse tool according to prior art. As can be seen from FIG. 3 the reaction force is already high in the beginning of the tightening. This since the reaction force is generated by the torque pulses, not the current pulse. Since the width of the current pulses is constant, but the torque pulses is wider in the beginning, the reaction force is not being built up linearly. Thus there is a large reaction force in the beginning that is experienced as uncomfortable by the operator since the operator is surprised by the high reaction force.

However, the inventor has realised that the characteristics of the reaction force can be improved by changing the characteristics of the current pulses supplied to the electric motor. This can be achieved by changing the relation between the current on time and the current off time for each period based on a parameter value reflecting amount of reaction force that the operator of the electric pulse tool can be exposed to.

One aspect of the present disclosure thus relates to a method for configuring an electric pulse tool 10, where torque is delivered in torque pulses on an output shaft 12 of the electric pulse tool 10. Wherein for each period a current pulse is provided to an electric motor during a first current on time and current feed is paused during a determined current off time ($T_{OFF}$). According to one aspect the method comprises the following steps. Retrieving a parameter value reflecting amount of reaction force that the operator of the electric pulse tool can be exposed to. Then determining the current off time $T_{OFF}$ based on the parameter value.

According to one exemplary embodiment the current off time $T_{OFF}$ is based on the parameter value such that a higher parameter value results in a longer current off time $T_{OFF}$ and a lower parameter value results in a shorter current off time $T_{OFF}$.

An advantage with this exemplary embodiment is that the operator can choose the characteristics of the reaction force that the electric pulse tool delivers to the operator by choosing the predetermined factor According to an exemplary embodiment the reaction force from the electric pulse tool 10 depends on the torque amplitude and the relationship between the width off the torque pulses and the off time of the torque pulses. The width of the torque pulses depends on the width of the current pulses. The off time of the torque pulses also depends on the off time of the current pulses. Therefore the characteristics of the reaction force can be changed by changing the relation between the current on time and the current off time $T_{OFF}$. This relation between the current on time and the current off time $T_{OFF}$ can be expressed by the parameter value reflecting amount of reaction force that the operator of the electric pulse tool can be exposed to. Where a higher parameter value results in a longer current off time $T_{OFF}$ and a lower parameter value results in a shorter current off time $T_{OFF}$.

According to another exemplary embodiment of the method the determined current off time $T_{OFF}$ comprises a first off interval until the end of the torque pulse and a second off interval after the end of the torque pulse and wherein the second off interval is further based on the width of the torque pulse, such that a wider torque pulse results in a wider off interval and a narrower torque pulse results in a shorter off interval.

At the beginning of a tightening the electric pulse tool tighten the screw during a longer time per pulse than at the end, which means that the width of the torque pulses are wider. The off intervals according to this exemplary embodiment of the invention are therefore determined to be wider in the beginning of the tightening in order to give a smoother built up of the reaction force.

Figure 4:
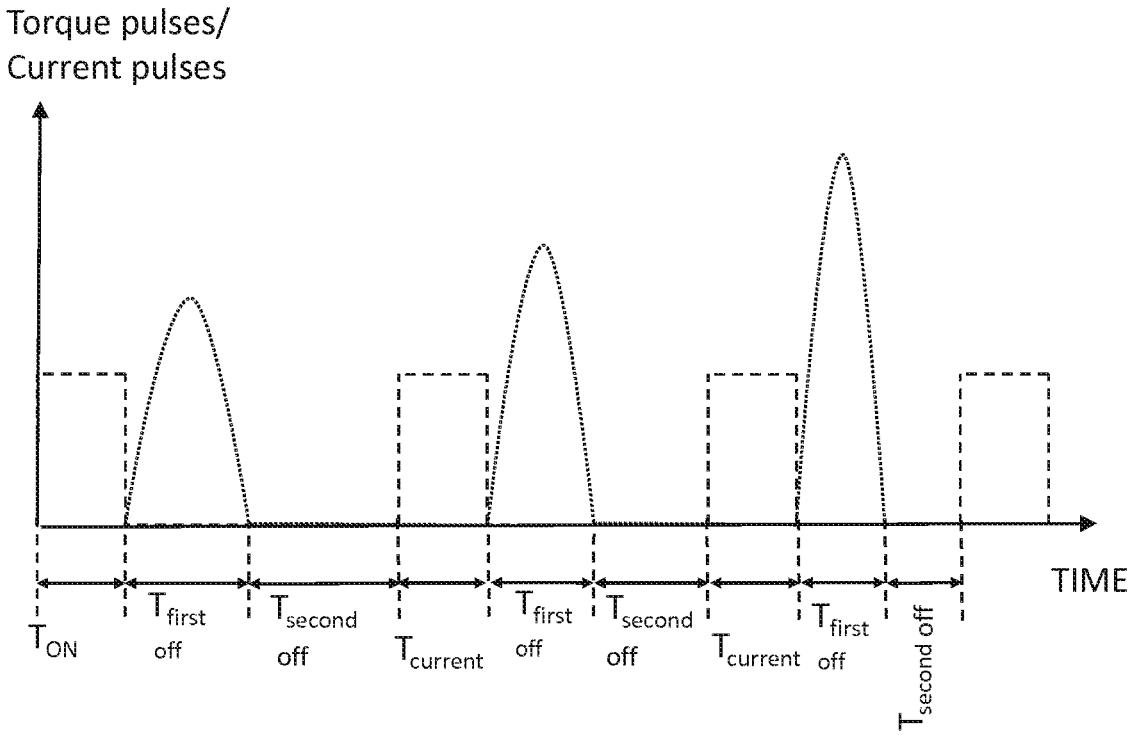
FIG. 4 depicts a diagram of a current pulse sequence according to an exemplary embodiment of the present disclosure.

FIG. 4 illustrates the method for configuring an electric pulse tool according to an exemplary embodiment wherein the determined current off time $T_{OFF}$ comprises a first off interval until the end of the torque pulse and a second off interval after the end of the torque pulse. And wherein the second off interval is further based on the width of the torque pulse. FIG. 4 also shows torque pulses according to an exemplary embodiment of the present disclosure. In FIG. 4 the width of the torque pulse corresponds to the first off interval, but in other exemplary embodiments the width of the torque pulse does not have to correspond to the first off interval.

As can be seen in FIG. 4, for each period a current pulse is provided to the electric motor during a current on time interval. Then current feed is paused to the electric motor during the first and second off intervals. In this exemplary embodiment the second off interval is further based on the width of the torque pulse, such that a wider torque pulse results in a wider second off interval and a narrower torque pulse results in a shorter second off interval.

According to an exemplary embodiment the reaction force from the electric pulse tool 10 depends on the torque amplitude and the relationship between the width off the torque pulses and the off time of the torque pulses. In the exemplary embodiment illustrated in FIG. 4 the off time for the torque pulses is the current on time interval plus the second off time interval. At the beginning of a tightening the electric pulse tool tighten the screw during longer time per pulse than at the end, which means that the width of the torque pulses are wider. The second off intervals according to an exemplary embodiment of the invention are therefore determined to be wider in the beginning of the tightening in order to give a smoother built up of the reaction force.

Figure 5:
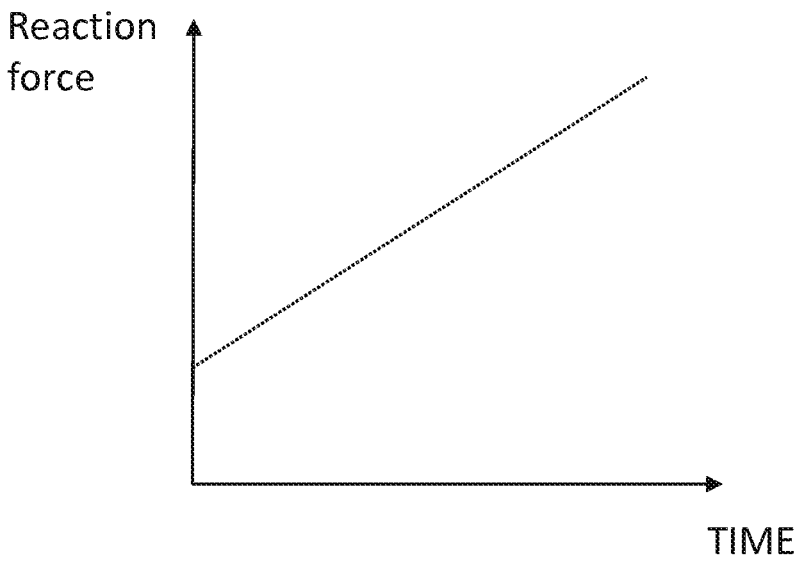
FIG. 5 depicts a diagram of the reaction force from an electric pulse tool according to an exemplary embodiment of the present disclosure.

FIG. 5 illustrates the reaction force that an operator experiences when using the tool according to an exemplary embodiment of the present disclosure. As can be seen from FIG. 5 the reaction force is low in the beginning of the tightening. The reaction force is also built up more linearly compared to prior art electric pulse tools. This since the reaction force is generated by the relation between the on time of the torque pulses and the off time of the torque pulses for each period. Since the off interval according to an exemplary embodiment is determined based on the width of the torque pulses, such that a wider torque pulse results in a wider off interval and a narrower torque pulse results in a shorter off interval, the reaction force is small in the beginning and built up more linearly. Thus this results in a small reaction force in the beginning that is experienced more comfortable by the operator since the operator is not surprised by the high reaction force.

In one exemplary embodiment of the method according to the present disclosure the width of the torque pulse is determined based on the interval from a first point in time when the electric pulse tool starts to transfer energy on the output shaft to a second point in time when the electric pulse tool stops to transfer energy on the output shaft.

In an exemplary embodiment of the method a torque sensor is used and if energy is transferred on the output shaft is determined based on the determined torque on the output shaft.

According to one exemplary embodiment of the method the output shaft is determined to stop transferring energy when the determined torque reaches essentially zero. According to one exemplary embodiment of the method the output shaft is determined to start transferring energy when the determined torque reaches essentially above zero. According to another exemplary embodiment of the method the sensor is a position sensor and if energy is transferred on the output shaft is determined based on the determined position change of the output shaft. According to another exemplary embodiment of the method the output shaft is determined to stop to transfer energy when the speed determined by the position sensor reaches essentially zero.

According to one exemplary embodiment of the method the output shaft is determined to start transferring energy when the determined speed determined by the position sensor reaches essentially above zero.

In an exemplary embodiment of the method the second off interval is a predetermined factor of the width of the torque pulse minus the current on time $T_{CURRENT}$.

$$T_{PAUSE}=(\text{factor}*T_{WIDTH})-T_{CURRENT}$$

In an exemplary embodiment of the method according to the present disclosure the method is performed in a tool controller.

In an exemplary embodiment of the method according to the present disclosure the parameter value is entered in the controller via a user interface of the controller.

In an exemplary embodiment of the method according to the present disclosure the method is performed in the electric pulse tool.

In an exemplary embodiment of the method according to the present disclosure the parameter value is entered in the electric pulse tool via a user interface of the electric pulse tool.

In an exemplary embodiment of the method according to the present disclosure the factor is received from e.g. a controller for an electric pulse tool. The factor may have been entered to the controller via a user interface of the controller.

In an exemplary embodiment of the method according to the present disclosure the parameter value is entered to the electric pulse tool via a user interface of the controller.

The present disclosure also relates to a computer-readable storage medium, having stored there on a computer program which, when run in a controller, causes the controller to perform the method as described above.

The present disclosure also relates to a computer-readable storage medium, having stored there on a computer program which, when run in an electrical pulse tool 10, causes the electrical pulse tool 10 to perform the method as described above.

According to one exemplary embodiment, when the above-mentioned computer program code is run in the processor 16 of the electric pulse tool 10 it causes the electric pulse tool 10 to provide a current pulse to the electric motor according to the methods described above.

Thus according to one exemplary embodiment the electric pulse tool 10 comprises the processor 16 and the memory 26 containing instructions executable by the processor 16, whereby the electrical pulse tool 10 for each period is operative to perform the method according to any of the above described exemplary embodiments.

The present disclosure also relates to a controller for an electric pulse tool, where torque is delivered in torque pulses on an output shaft of the electric pulse tool. Wherein for each period a current pulse is provided to an electric motor during a first current on time and current feed is paused during a determined current off time $T_{OFF}$. The controller is operative to: retrieve a parameter value reflecting amount of reaction force that the operator of the electric pulse tool can be exposed to. And determine the current off time $T_{OFF}$ based on the parameter value, where a higher parameter value results in a longer current off time $T_{OFF}$ and a lower parameter value results in a shorter current off time $T_{OFF}$.

In another exemplary embodiment of the controller, the determined current off time $T_{OFF}$ comprises a first off interval until the end of the torque pulse and a second off interval after the end of the torque pulse and wherein the second off interval is further based on the width of the torque pulse, such that a wider torque pulse results in a wider off interval and a narrower torque pulse results in a shorter off interval.

In yet another exemplary embodiment of the controller, the second off interval is the parameter value times the width of the torque pulse minus the current on time.

$$T_{SECOND\ OFF\ INTERVALL}=(\text{parameter value}*T_{WIDTH})-T_{ON}$$

In yet another exemplary embodiment of the controller, the parameter value is entered in the controller via a user interface of the controller.

In yet another exemplary embodiment the controller is part of an electric pulse tool 10.

According to another exemplary embodiment the controller comprises a processor and the memory containing instructions executable by the controller, whereby the controller for each period is operative to perform the method according to any of the above described exemplary embodiments.

The invention claimed is:

1. A method for an electric pulse tool, the electric pulse tool being configured to deliver torque in torque pulses on an output shaft thereof, wherein for each of a plurality of periods a current pulse is provided to an electric motor during a current-on time and a current feed is paused during a determined current-off time, the method comprising:

retrieving a parameter value reflecting an amount of reaction force that an operator of the electric pulse tool can be exposed to; and determining the current-off time based on the parameter value, wherein the determined current-off time comprises a first off interval until an end of a torque pulse and a second off interval after the end of the torque pulse, and wherein the second off interval is determined based on a width of the torque pulse, such that a wider torque pulse results in a wider off interval and a narrower torque pulse results in a shorter off interval.

2. The method according to claim 1, wherein where a higher parameter value results in a longer current-off time and a lower parameter value results in a shorter current-off time.

3. The method according to claim 2, wherein the second off interval is the parameter value times the width of the torque pulse minus the current-on time, as follows:

$$T_{SECOND\ OFF}=(\text{parameter value}*T_{WIDTH})-T_{ON},$$

where $T_{SECOND\ OFF}$ is the second off interval, $T_{WIDTH}$ is the width of the torque pulse, and $T_{ON}$ is the current-on time.

4. The method according to claim 1, wherein the method is performed in a tool controller.

5. The method according to claim 4, wherein the parameter value is entered in the controller via a user interface of the controller.

6. The method according to claim 1, wherein the method is performed in the electric pulse tool.

7. The method according to claim 6, wherein the parameter value is entered in the electric pulse tool via a user interface of the electric pulse tool.

8. A controller for an electric pulse tool, the electric pulse tool being configured to deliver torque in torque pulses on an output shaft thereof, wherein for each of a plurality of periods a current pulse is provided to an electric motor during a current-on time and a current feed is paused during a determined current-off time, the controller being configured to:

retrieve a parameter value reflecting an amount of reaction force that an operator of the electric pulse tool can be exposed to; and determine the current-off time based on the parameter value, wherein a higher parameter value results in a longer current-off time and a lower parameter value results in a shorter current-off time, wherein the determined current-off time comprises a first off interval until an end of a torque pulse and a second off interval after the end of the torque pulse, and wherein the second off interval is determined based on a width of the torque pulse, such that a wider torque pulse results in a wider off interval and a narrower torque pulse results in a shorter off interval.

9. The controller according to claim 8, wherein the second off interval is the parameter value times the width of the torque pulse minus the current-on time, as follows:

$$T_{SECOND\ OFF}=(\text{parameter value}*T_{WIDTH})-T_{ON},$$

where $T_{SECOND\ OFF}$ is the second off interval, $T_{WIDTH}$ is the width of the torque pulse, and $T_{ON}$ is the current-on time.

10. The controller according to claim 8, wherein the parameter value is entered in the controller via a user interface of the controller.

11. The controller according to claim 8, wherein the controller is part of an electric pulse tool.

12. A non-transitory computer-readable storage medium, having stored thereon a computer program executable by a controller that controls an electric pulse tool, the electric pulse tool being configured to deliver torque in torque pulses on an output shaft thereof, wherein for each of a plurality of periods a current pulse is provided to an electric motor during a current-on time and a current feed is paused during a determined current-off time, the program being executable by the controller to perform operations comprising:

retrieving a parameter value reflecting an amount of reaction force that an operator of the electric pulse tool can be exposed to; and determining the current-off time based on the parameter value, wherein the determined current-off time comprises a first off interval until an end of a torque pulse and a second off interval after the end of the torque pulse, and wherein the second off interval is determined based on a width of the torque pulse, such that a wider torque pulse results in a wider off interval and a narrower torque pulse results in a shorter off interval.

* * * * *